United States Patent [19]

Grilliot et al.

[11] Patent Number: 4,999,850

[45] Date of Patent: Mar. 19, 1991

[54] FIREFIGHTER'S INTEGRATED GARMENT

[76] Inventors: William L. Grilliot; Mary I. Grilliot, both of 1986 Home Ave., Dayton, Ohio 45417

[21] Appl. No.: 457,292

[22] Filed: Dec. 26, 1989

[51] Int. Cl.[5] ..... A41B 1/08

[52] U.S. Cl. ..... 2/126; 2/70; 2/93; 2/97

[58] Field of Search ..... 2/69, 70, 81, 82, 85, 2/86, 87, 93, 94, 95, 97, 126, 243 R, 272, DIG. 6

[56] References Cited

U.S. PATENT DOCUMENTS

| | | | |
|---|---|---|---|
| 1,489,046 | 4/1924 | Thompson | 2/70 |
| 1,505,053 | 8/1924 | Millhauser | 2/93 |
| 2,128,193 | 8/1938 | Shane | 2/97 |
| 2,295,741 | 9/1942 | Kessler | 2/126 |
| 2,465,286 | 3/1949 | Silver | 2/82 |
| 3,130,416 | 4/1964 | Mitchell | 2/126 |
| 4,006,495 | 2/1977 | Jones | 2/93 |
| 4,507,806 | 4/1985 | Coombs | 2/97 |
| 4,569,089 | 2/1986 | Nesse | 2/126 |
| 4,864,656 | 9/1989 | Nesse | 2/243 R |

FOREIGN PATENT DOCUMENTS

| | | | |
|---|---|---|---|
| 518480 | 4/1953 | Belgium | 2/126 |
| 3139463 | 4/1983 | Fed. Rep. of Germany | 2/70 |
| 602877 | 4/1926 | France | 2/126 |
| 772125 | 8/1934 | France | 2/126 |
| 927147 | 10/1947 | France | 2/126 |
| 1005577 | 4/1952 | France | 2/126 |
| 1022497 | 12/1952 | France | 2/94 |
| 1188180 | 9/1959 | France | 2/70 |
| 1408827 | 7/1965 | France | 2/DIG. 6 |
| 355023 | 8/1931 | United Kingdom | 2/126 |

*Primary Examiner*—Werner H. Schroeder
*Assistant Examiner*—Diana L. Biefeld
*Attorney, Agent, or Firm*—Jacox & Meckstroth

[57] ABSTRACT

A firefighter's garment of the type having an outer shell layer and a moisture barrier layer and a thermal barrier layer. This invention pertains primarily to a firefighter's bunker coat having these three layers. In a firefighter's bunker coat of this invention the thermal barrier layer is composed of a plurality of sections. For example, there may be a pair of sleeve sections and a vest section. Each of the sections is separately releasably attached within the bunker coat, and therefore can be easily removed from the bunker coat and easily reinserted into the coat and attached thereto, as desired.

7 Claims, 2 Drawing Sheets

FIG-5
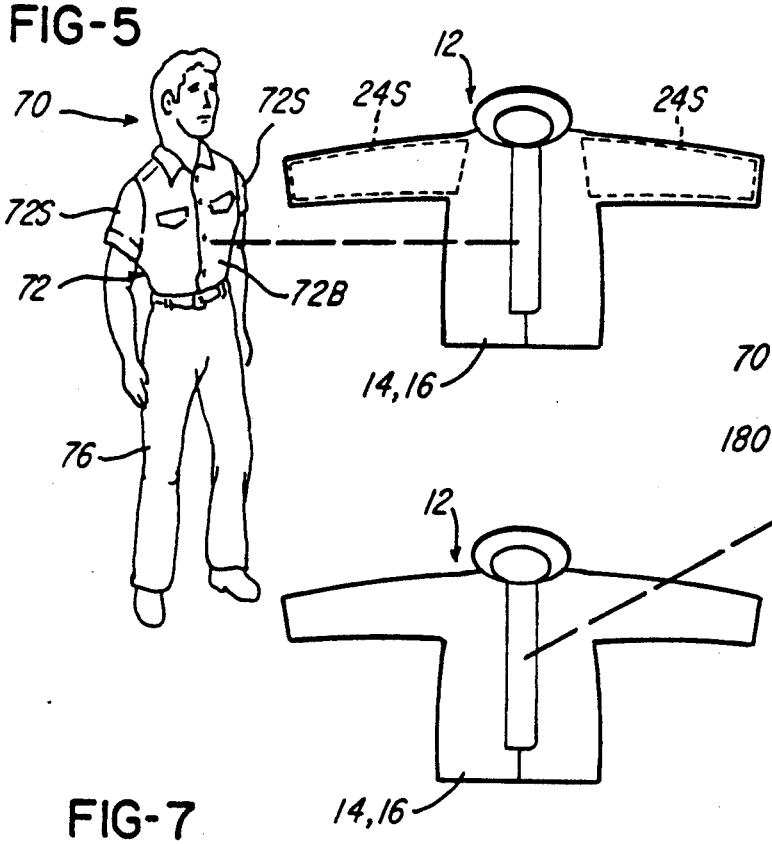
FIG-6
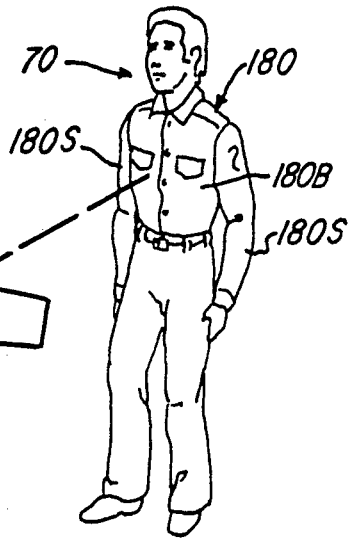
FIG-7
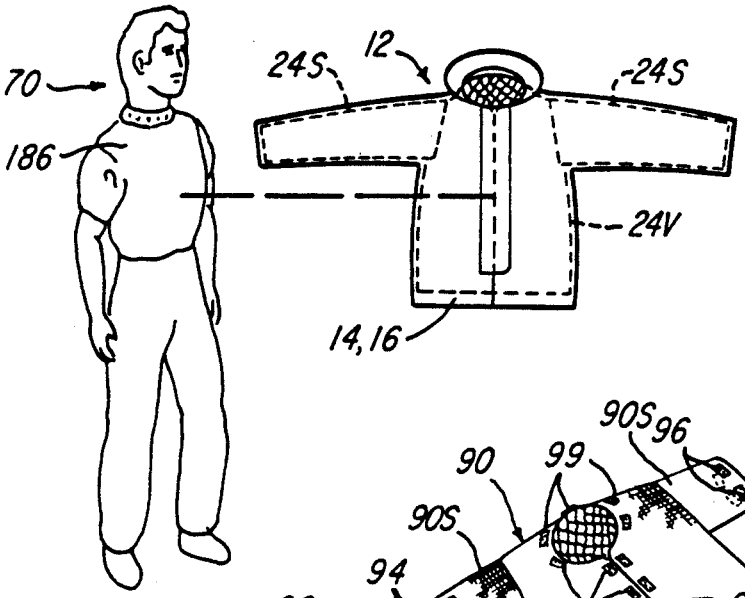
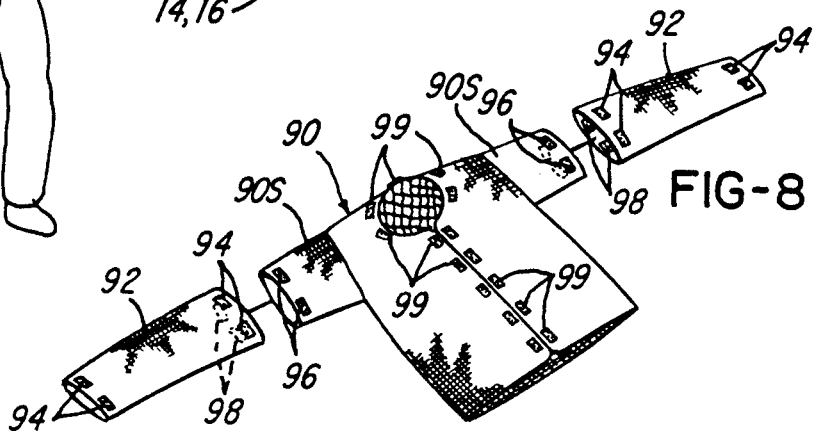
FIG-8

FIREFIGHTER'S INTEGRATED GARMENT

BACKGROUND OF THE INVENTION

A firefighter's garments normally include a bunker coat and bunker trousers. Each of these garments conventionally comprises an outer layer or shell which is flame and abrasion resistant and an intermediate liner which is a moisture barrier layer and an inner liner which is a thermal barrier layer. Conventionally, these layers may be three separate distinct layers or one or two members. A firefighter's coat or jacket normally includes a body portion and a pair of arm length sleeve portions.

Most injuries to firefighters and most deaths of firefighters occur as a result of stress to the firefighter during firefighting activity. Therefore, attempts have been made to reduce the stress which occurs in a firefighter by reducing the weight of clothing worn by the firefighter during firefighting activity and by providing greater ventilation within the firefighter's clothing during firefighting activity.

In many fire department stations the firefighters who are on duty and on call wear station trousers composed of thermal protective materials. During the day, the firefighters are wearing these station trousers when they don firefighting bunker trousers. Under these conditions the conventional thermal liners may be removed from the firefighters' firefighting trousers since they are effectively replaced by the station trousers which contain thermal insulation material. To wear two layers of thermal protective material (station trousers and liner layer of firefighting bunker trousers) while fighting a fire would add unnecessary bulk and impose unnecessary stress on the firefighter. When the firefighters don their firefighting bunker trousers, the firefighters have the thermal protection of their station trousers and the moisture protection of the moisture barrier layer within their firefighting trousers and the flame and abrasion protection of the shell of their firefighting trousers. Therefore, when the firefighters don their firefighting bunker trousers they have proper thermal protection, while also having proper moisture and flame and abrasion protection.

When the firefighters prepare for sleeping they remove their station trousers. Therefore, the firefighters place the conventional thermal protective liners back into their firefighting bunker trousers. Thus, during sleeping periods the firefighters' bunker trousers have the thermal protective liners therein, as well as the moisture barrier layer and the flame and abrasion resistant shell. Thus, the firefighters' bunker uniforms are ready for donning when a fire call is received in the fire station. Therefore, a firefighter can quickly don the firefighting bunker trousers. In this procedure the firefighter always wears adequate protective trousers during firefighting activity, but duplication of protective material within the clothing worn during firefighting does not occur.

Such an integrated liner removal procedure with regard to a firefighter's bunker coat is much more difficult. In many fire stations a firefighter while on duty in the fire station wears a shirt which is composed of thermal protective material. Under these conditions a firefighter may remove the thermal barrier liner from the firefighter's bunker coat. Thus, when the thermal barrier liner is removed, the firefighter's bunker coat contains only a moisture barrier layer and an abrasion and flame resistant shell. When a fire call alarm is received in the fire station, the firefighter dons the bunker coat. When this occurs the firefighter is protected by the thermal barrier material of the station shirt and by the moisture barrier material liner and the abrasion resistant shell of the bunker coat. Such a procedure is proper when the firefighter wears a shirt with arm length sleeves while in the fire station and while on call.

However, in summer many firefighters wear a short sleeve shirt while on duty and on call in the fire station. Under these conditions the firefighter can not remove the thermal barrier liner from the firefighter's bunker coat due to the fact that there would not be proper thermal protection of the firefighter's arms when the firefighter's bunker coat is donned. This mix of long/-short sleeve style station shirts, (typically by season) has caused most fire departments to avoid removable thermal liners in firefighters' coats, even though such a move would be less stressful to the firefighter when station shirts are worn during firefighting activity.

An object of this invention is to provide means and a method by which the same firefighter's bunker coat can always be adequately prepared for donning and for firefighting activity while the firefighter is on duty and on call in the fire station, wearing either full length or short sleeve station uniform shirts.

Another object of this invention is to provide such means and method by which the firefighter's bunker coat having removable portions is always prepared with adequate protective material but without excessive duplication of protective material when considering the interplay with thermally protective station shirts (either short or long sleeve).

Another object of this invention is to provide such means and a method by which a firefighter's bunker coat can be easily and readily adequately prepared for firefighting activity regardless of the nature of the clothing worn by the firefighter while on call and on duty in a fire station.

Other objects and advantages of this invention reside in the construction of parts, the combination thereof, the method of production and the mode of use, as will become more apparent from the following description.

SUMMARY OF THE INVENTION

This invention relates to the clothing of a firefighter while the firefighter is on duty and on call in a fire station. This invention also relates to a firefighter's bunker uniform which is donned by the firefighter when the firefighter responds to a fire alarm.

A firefighter while on duty in a fire station may wear a shirt which has thermal protection qualities. When the firefighter wears a shirt having thermal protection qualities, the portions of the firefighter's body which are covered by the shirt have thermal protection. Therefore, those portions do not need to be covered by thermal protection material within the firefighter's bunker coat which the firefighter dons when the firefighter responds to a fire alarm.

Therefore, the firefighter's bunker coat which is prepared for donning may include thermal protective material only in regions which are not covered by the firefighter's clothing as the firefighter is on duty in the fire station.

In this invention the layer of thermal protective material within a firefighter's bunker coat includes sections which are releasably attached within the firefighter's bunker coat and which are readily removable from the firefighter's bunker coat. These sections of thermal protective material are readily replaceable and reattachable within the firefighter's bunker coat. Thus, sections of the layer of thermal protective material within a firefighter's bunker coat may be removed therefrom for any purpose. For example, sections of the layer of thermal protective material may be removed from the firefighter's bunker coat when such sections are adapted to cover parts of the firefighter's body which are covered by thermal protective material worn by the firefighter while on duty in the fire station. When the firefighter changes clothes, some of the sections or all of the sections of the thermal protective material may be readily and quickly replaced and attached within the firefighter's bunker coat. In some situations, when a firefighter changes clothes, sections of the thermal protective material within the firefighter's bunker coat may be removed, while other sections of the thermal protective material which have been removed are replaced into the firefighter's bunker coat. The sections of removable and replaceable thermal protective material within a firefighter's coat may include sleeve sections and vest sections.

BRIEF DESCRIPTION OF THE VIEWS OF THE DRAWINGS

FIG. 5 is a perspective view of a firefighter showing a certain type of clothing worn by a firefighter within a fire station and showing, in elevation and in a larger scale, the firefighter's bunker coat and illustrating the formation of thermal protective material within the firefighter's bunker coat when the firefighter is dressed as shown in FIG. 5.

FIG. 6 is a perspective view of a firefighter showing another type of clothing worn by the firefighter within the fire station and showing, in elevation and in a larger scale, the firefighter's bunker coat and illustrating the formation of the firefighter's bunker coat when the firefighter is dressed as shown in FIG. 6.

FIG. 7 is a perspective view of a firefighter showing another type of clothing worn by the firefighter within the fire station and showing, in elevation and in a larger scale, the firefighter's bunker coat and illustrating the formation of the thermal protective material within the firefighter's bunker coat when the firefighter is dressed as shown in FIG. 7.

FIG. 8 is a perspective view showing a modification of the thermal protective sections which are positionable within the firefighter's bunker coat.

DETAILED DESCRIPTION OF THE PREFERRED EMBODIMENT OF THE INVENTION

As stated above, a firefighter's bunker coat customarily includes an outer shell which is of flame resistant and abrasion resistant material. The firefighter's bunker coat also customarily includes a moisture barrier layer or liner within the outer shell and a thermal barrier layer which is covered by the moisture barrier layer or liner.

In accordance with this invention, the thermal protective material which is in the form of a thermal barrier layer or liner is comprised of several sections which are releasably attached within the outer shell of the moisture barrier layer and which are readily removable from the outer shell and from the moisture barrier layer. Furthermore, the several sections of the thermal barrier layer are also readily reattachable within the outer shell and the moisture barrier layer. The sections of the thermal barrier layer which are removable from the outer shell and from the moisture barrier layer are directly related to the type or style or structure of the clothing worn by the firefighter while the firefighter is on duty and on call in a fire station.

Figure 1:
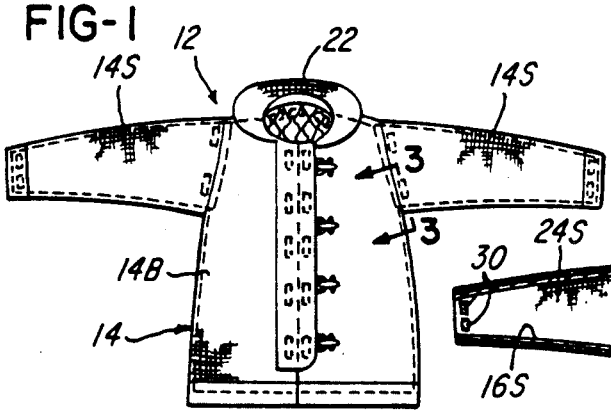
FIG. 1 is a front elevational view of a firefighter's bunker coat which is constructed in accordance with this invention.
Figure 2:
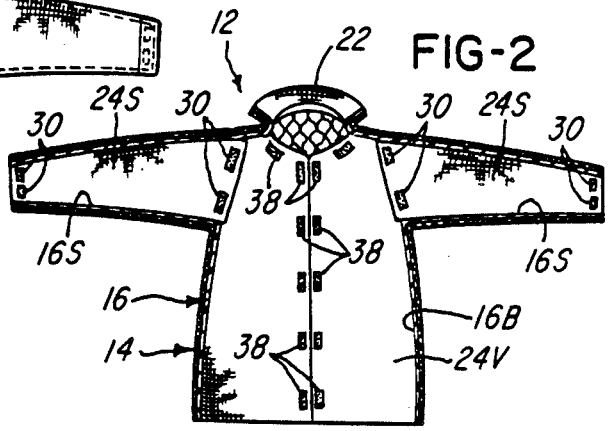
FIG. 2 is a front sectional view of the firefighter's bunker coat of FIG. 1, showing the means for attachment of the thermal protective liner elements within the firefighter's bunker uniform coat.
Figure 3:
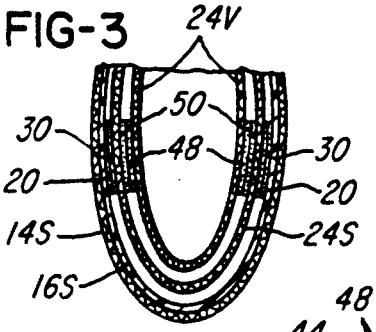
FIG. 3 is a greatly enlarged sectional view taken substantially on line 3—3 of FIG. 1.
Figure 4:
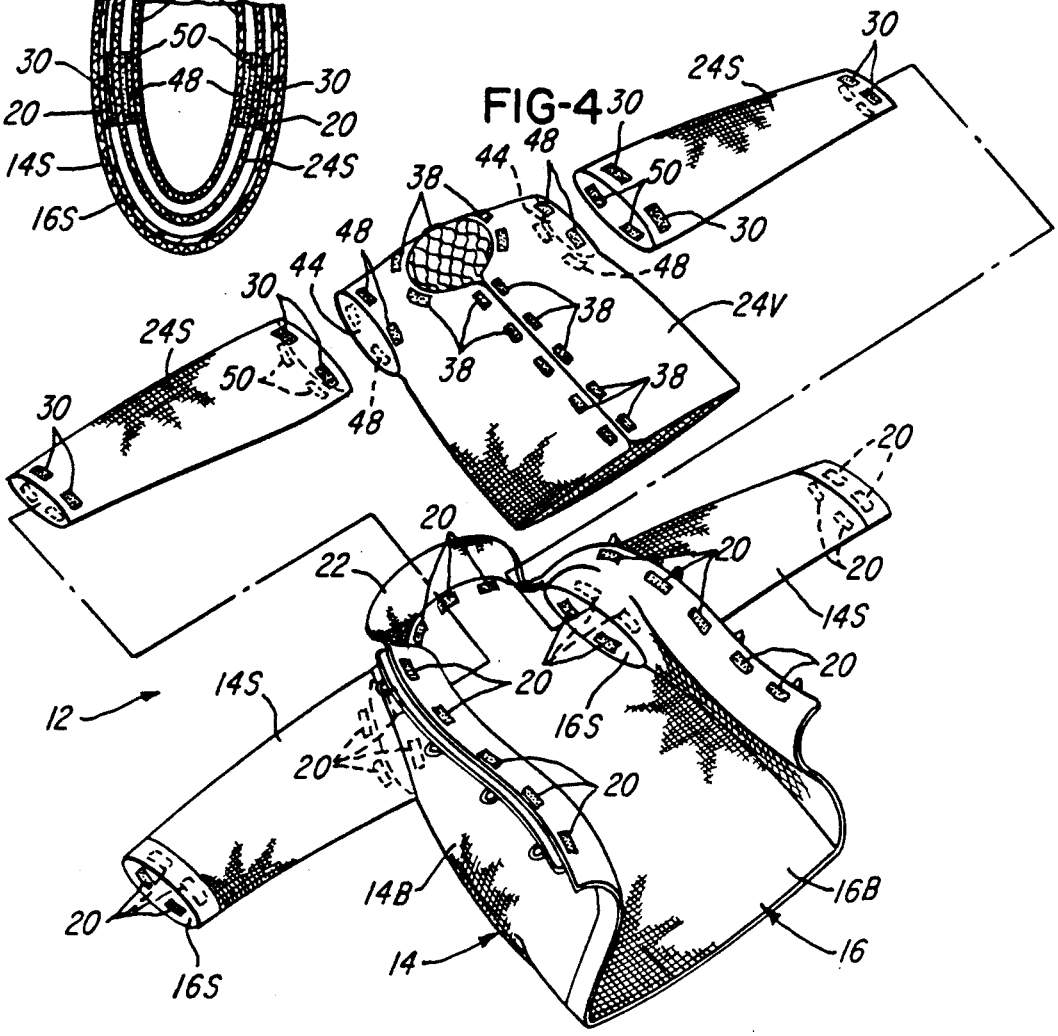
FIG. 4 is a perspective exploded view of the firefighter's bunker coat of FIG. 1, drawn on a slightly larger scale than FIG. 1, illustrating the structure and method of attachment of the thermal protective sections to other portions of the firefighter's bunker coat.

FIGS. 1–4 illustrate a firefighter's bunker coat 12 which includes an outer shell 14 and a moisture barrier layer 16 within the outer shell 14. The outer shell 14 may, for example, be any suitable high temperature abrasion resistant nylon material or the like. The moisture barrier layer 16 may, for example, be neoprene material or a poly teflon fluro ethylene material or the like. Preferably, the moisture barrier layer 16 is secured in a suitable manner to the outer shell 14 and within the outer shell 14. The outer shell 14 includes a body part 14B and a pair of sleeve parts 14S. The moisture barrier layer 16 includes a pair of sleeve parts 16S and a body part 16B. Secured on the inner surface of the moisture barrier layer 16 are releasable attachment elements 20, which may be of any suitable kind or type. Herein, the attachment elements 20 are shown as being of the hook and pile type. The attachment elements 20 are secured to the moisture barrier layer 16 at the end regions of the sleeve parts 16S of the moisture barrier layer 16 and at the juncture between the sleeve parts 16S and body part 16B. The attachment elements 20 are also secured to the moisture barrier layer 16 at the central front part of the body part 16B and adjacent a collar 22 of the moisture barrier layer 16.

Positionable within the outer shell 14 and within the moisture barrier layer 16 is a thermal barrier layer 24. The thermal barrier layer 24 is of any suitable thermal protective material which has good thermal insulation qualities. The thermal barrier layer 24 comprises sleeve sections 24S of thermal protective material and a vest section 24V of thermal protective material. Secured to the outer surface of the sleeve sections 24S are attachment elements 30, which are shown as being of the hook and pile type and which are complementary to the hook and pile attachment elements 20 which are secured to the sleeve parts 16S of the moisture barrier layer 16. The attachment elements 30 of the sleeve sections 24S of the thermal barrier layer 24 are attachable to attachment elements 20 which are within the sleeve parts 16S of the moisture barrier layer 16.

The vest section 24V of the thermal protective layer 24 has hook and pile attachment elements 38 which are complementary to and attached to the hook and pile attachment elements 20 which are secured to the moisture barrier layer 16. The vest section 24V has arm openings 44. On the exterior surface of each of the arm openings 44 are attachment elements 48 which are attachable to attachment elements 50 which are secured within the sleeve sections 24S adjacent the junctures of the sleeve sections 24S and the vest section 24V. Thus, the sleeve sections 24S of the thermal protective material are releasably attached to the vest section 24V.

As stated above, a firefighter while on duty and on call in a fire station may wear various types and styles of clothing.

FIG. 5 shows a firefighter 70 who is wearing in a fire station a shirt 72 and trousers 76. At least, the shirt 72 is constructed of thermal protective material. The shirt 72 has relatively short sleeves 72S and a body portion 72B. Therefore, the upper body portion and the upper part of the arms of the firefighter have thermal protection provided by the shirt 72. Thus, while the firefighter is on duty in the fire station and wearing the shirt 72, the firefighter's bunker coat 12 which is positioned ready for use when an alarm is received, does not require the vest section 24V of thermal insulation material. Therefore, the vest section 24V is detached from the moisture barrier layer 16 and is removed from the firefighter's bunker coat 12. The vest section 24V is detached from the moisture barrier 16 as the attachment elements 38 which are secured to the vest section 24V are released from the attachment elements 20 which are secured to the moisture barrier layer 16. Also, as the vest section 24V is detached from the moisture barrier layer 16, the attachment elements 48 which are secured to the vest section 24V adjacent the arm openings 44 of the vest section 24V are released from the attachment elements 50 which are secured to the sleeve sections 24S, adjacent the arm openings 44 of the sleeve section 24S.

Therefore, when the firefighter 70 is dressed as shown in FIG. 5, the firefighter's bunker coat 12, as it is prepared for donning by the firefighter, includes as thermal insulation material, only the sleeve sections 24S of thermal insulation material, as illustrated in FIG. 5. Under these conditions, when a fire alarm is received, the firefighter dons the bunker coat 12, and the bunker coat 12 and the shirt 72 of the firefighter 70 include all of the necessary protective material for the part of the firefighter 70 between the waist and the neck of the firefighter 70.

It is noted that the sleeves 72S of thermal protection material of the firefighter's shirt 72 and the parts of the sleeve section 24S of thermal protective material which cover the sleeves 72S provide double thermal protection in upper portions of the arms of the firefighter 70. However, this double thermal protection is not necessary.

When the firefighter 70 wears the clothing as shown in FIG. 5, the shirt 72 of the firefighter 70 has relatively short sleeves 72S. As stated above, the firefighter's shirt 72 comprises thermal protective material. Therefore, a vest section 90 of the firefighter's bunker coat 12 may be constructed as shown in FIG. 8. The vest section 90 has short sleeve portions 90S which are substantially the same length as the sleeves 72S of the firefighter's shirt 72. While the firefighter 70 is on duty and on call in a fire station, the firefighter's bunker coat 12 contains the sleeve sections 92, shown in FIG. 8, which are not full arm length sleeves, and cover only the parts of the firefighter's arms from the firefighter's hand to the sleeves 72S. These sleeve sections 92 are attached to the moisture barrier layer 16 within the firefighter's bunker coat 12 by suitable connection elements 94. Thus, the firefighter's bunker coat 12 is in proper condition for quick donning by the firefighter 70 when the firefighter 70 is wearing the shirt 72 and when a fire alarm is received in the fire station. When the firefighter 70 dons the firefighter's bunker coat 12 with the sleeve sections 92 therein, the firefighter 70 has complete thermal protection, due to the fact that the shirt 72 worn by the firefighter 70 is of thermal protective material, and the sleeves 72S of the shirt 72 are positioned in juxtaposition with the sleeve sections 92 of thermal protective material which are within the firefighter's bunker coat 12.

When the firefighter 70 removes the firefighter's shirt 72 in the fire station, the firefighter 70 places the vest section 90 into the firefighter's bunker coat 12 and attaches the vest section 90 to the moisture barrier liner 16 and attaches the sleeves 90S of the vest section 90 to the sleeve sections 92 which are of thermal protective material. The vest section 90 has connection elements 96 on the outer surface of the sleeves 90S. The connection elements 96 of the sleeves 90S are attached to connection elements 98 which are secured on the inner surface of the sleeve sections 92. The vest section 90 has connection elements 99 which are attached to attachment elements 20 of the moisture barrier layer 16 of the firefighter's bunker coat 12. Thus, the firefighter's bunker coat 12 is in condition to be quickly donned by the firefighter 70 when the firefighter 70 is not wearing the shirt 72.

FIG. 6 shows the firefighter 70 as the firefighter 70, in station clothing, is wearing a shirt 180 which includes a body portion 180B and arm length sleeves 180S. The body portion 180B and the sleeves 180S are constructed of thermal protective material. When the firefighter 70 is so dressed, the firefighter's bunker coat 12 requires no additional thermal protection material. Therefore, as the firefighter's bunker coat 12 in the fire station, is prepared for donning in response to a fire alarm, the sleeve sections 24S and the vest section 24V are removed from the bunker coat 12, and the bunker coat 12 includes only the outer shell 14 and the moisture barrier layer 16, as illustrated in FIG. 6. When the sleeve sections 24S and the vest section 24V of thermal protective material are removed from the firefighter's bunker coat 12, the firefighter's bunker coat 12 appears generally as illustrated in FIG. 6 and includes only the outer shell 14 and the moisture barrier layer 16.

When the firefighter 70 dressed in the manner shown in FIG. 6 dons the bunker coat 12 shown in FIG. 6, the firefighter 70 has adequate thermal protection due to the fact that the firefighter shirt 180 comprises thermal protection material. Therefore, the firefighter 70 wearing the bunker coat 12 has adequate protection provided by the outer shell 14 and the moisture barrier layer 16 and the thermal barrier material provided by the shirt 180.

On various occasions a firefighter, while on duty and on call in a fire station, wears clothing which does not include thermal protective material. FIG. 7 shows the firefighter 70 as the firefighter 70 wears clothing, including a shirt 186, which does not have thermal protective material. When the firefighter 70 is so dressed, the firefighter's bunker coat 12 has the sleeve sections 24S and the vest section 24V attached therein.

When the vest section 24V and the sleeve sections 24S are positioned within the moisture barrier layer 16, the attachment elements 30 of the sleeve sections 24S are attached to the attachment elements 20 of the sleeve portions 16S of the moisture barrier layer 16. Also, the attached elements 38 of the vest section 24V are attached to the attachment elements 20 of the body portion 16B of the moisture barrier layer 16. Furthermore, the attachment elements 48 of the vest section 24V are attached to the attachment elements 50 of the sleeve sections 24S. Thus, the firefighter's bunker coat 12, as shown in FIG. 7, is in proper condition for quick donning by the firefighter. The vest section 24V and the sleeve sections 24S are releasably attached within the firefighter's bunker coat 12.

Thus, it is understood that this invention provides structure and a method by which a firefighter while on duty and on call in a fire station can properly prepare the firefighter's bunker coat for quick donning when a fire alarm is received in the station. The firefighter's bunker coat is prepared to provide adequate thermal protection in consideration of the thermal protection provided by the clothes worn by the firefighter in the fire station. The thermal protection provided by the thermal protective material in the station clothes worn by the firefighter is such that additional thermal protection in the firefighter's bunker coat is not necessary in the parts of the firefighter's body which are covered by the station clothes of the firefighter. Thus, adequate protection is provided for the firefighter, and the total clothing worn by the firefighter during fire fighting activity is of minimum weight. Thus, stress upon the firefighter as a result of the clothing worn by the firefighter is a minimum.

Although the preferred embodiment of the firefighter's bunker coat and the method of this invention have been described, it will be understood that within the purview of this invention various changes may be made in the form, details, proportion and arrangement of parts, the combination thereof, and the method of use, which generally stated consist in a firefighter's bunker coat and a method within the scope of the appended claims.

The invention having thus been described, the following is claimed:

1. A firefighter's coat and fire station shirt combination for a firefighter who wears a fire station shirt of thermal protective material while in a fire station, the firefighter's shirt having a vest portion provided with shoulder parts and short sleeves which extend from the shoulder parts to positions between the shoulders and elbows of the firefighter who wears the fire station shirt said firefighter's coat comprising an outer shell of abrasion resistant and flame resistant material, a moisture barrier layer within the outer shell and carrier thereby, the moisture barrier layer including a body portion and a pair of arm length sleeve portions, each of the arm length sleeve portions of the moisture barrier layer having a wrist region and a shoulder region and extending between the wrist region and the shoulder region with an elbow region between the wrist region and the shoulder region, a thermal protective layer, the thermal protective layer including a pair of sleeve sections of thermal protective material, there being a sleeve section of thermal protective material carried by each of the sleeve portions of the moisture barrier layer, each of the sleeve sections of the thermal protective material having a wrist region positioned adjacent the wrist region of one of the sleeve portions of the moisture barrier layer, each of the sleeve sections of the thermal protective material extending from the wrist region of the moisture barrier layer to a position between the elbow region and the shoulder region of a sleeve portion of the moisture barrier layer, each of the sleeve sections of the thermal protective material having an upper region which is positioned adjacent one of the short sleeves of the fire station shirt when the firefighter dons the firefighter's coat while the firefighter is wearing the fire station shirt, whereby the firefighter who wears the firefighter's coat has proper thermal protection when the firefighter dons the firefighter's coat while the firefighter wears the fire station shirt, and whereby the firefighter's coat has minimum weight and stress upon the firefighter who wears the firefighter's coat is minimal, while permitting the firefighter to be properly dressed in the fire station and to quickly don proper protective clothing.

2. The firefighter's coat of claim 1 in which the wrist region of each of the sleeve sections of thermal protective material is attached to the wrist region of one of the arm length sleeve portions of the moisture barrier layer.

3. The firefighter's coat of claim 1 in which the upper region of each of the sleeve sections of thermal protective material is attached to one of the arm length sleeve portions of the moisture barrier layer.

4. A firefighter's coat for a firefighter who occasionally wears a fire station shirt of thermal protective material while in a fire station, the firefighter's shirt having a vest portion provided with shoulder parts and short sleeves which extend from the shoulder parts to positions between the shoulders and elbows of the firefighter said firefighter's coat comprising an outer shell of abrasion resistant and flame resistant material, a moisture barrier layer within the outer shell and carried thereby, the moisture barrier layer including a body portion and a pair of arm length sleeve portions, each of the arm length sleeve portions of the moisture barrier layer having a wrist region and a shoulder region and extending between the wrist region and the shoulder region with an elbow region between the wrist region and the shoulder region, a thermal protective layer, the thermal protective layer including a pair of sleeve sections of thermal protective material, there being a sleeve section of thermal protective material carrier by each of the sleeve portions of the moisture barrier layer, each of the sleeve sections of the thermal protective material having a wrist region positioned adjacent the wrist region of one of the sleeve portions of the moisture barrier layer, each of the sleeve sections of the thermal protective material extending from the wrist region of the moisture barrier layer to a position between the elbow region and the shoulder region of a sleeve portion of the moisture barrier layer, each of the sleeve sections of the thermal protective layer having an upper region which is positioned adjacent one of the short sleeves of the fire station shirt but not connected thereto when the firefighter dons the firefighter's coat while the firefighter is wearing the fire station shirt, whereby the firefighter who wears the firefighter's coat has proper thermal protection when the firefighter dons the firefighter's coat while the firefighter wears the station shirt, the thermal protective layer also including a body section which comprises a vest portion provided with shoulder parts and short sleeves which extend from the shoulder parts to positions between the shoulder region and elbow region of the arm length sleeve portions of the moisture barrier layer when the body section is within the firefighter's coat, the body section being positioned within the firefighter's coat and enclosed by the moisture barrier layer when the firefighter is not wearing a fire station shirt, whereby the firefighter who wears the firefighter's coat has proper thermal protection when the firefighter dons the firefighter's coat when the firefighter is not wearing a fire station shirt, and whereby the weight of the firefighter's coat is always minimal and whereby stress upon the firefighter who wears the firefighter's coat is minimal while permitting the firefighter to be properly dressed in preparation for firefighting.

5. The firefighter's coat of claim 4 which includes means for attachment of the body section of the thermal protective layer to the moisture barrier layer.

6. The firefighter's coat of claim 4 which includes means for attaching the sleeve sections of the thermal protective layer to the short sleeves of the body section of the thermal protective layer.

7. The method of construction of a firefighter's bunker coat for a firefighter who wears a fire station shirt of thermal protective material in which the fire station shirt has short sleeves, comprising providing an outer protective layer of abrasion resistant and flame resistant material in which the outer protective layer includes a body and a pair of arm length sleeve parts, providing a layer of moisture barrier material which includes a body part and a pair of arm length sleeve parts, each of the arm length sleeve parts of the moisture barrier layer having a wrist portion and a shoulder portion and an elbow portion between the wrist portion and the shoulder portion, positioning the outer protective layer in covering relationship over the layer of moisture barrier material, providing a pair of sleeve sections of thermal protective material, covering the sleeve sections of thermal protective material with the sleeve parts of the layer of moisture barrier material whereby each of the sleeve sections of the thermal protective material extends from the wrist portion of one of the arm length sleeve parts of the moisture barrier layer to a position between the elbow portion and the shoulder portion of the respective sleeve part of the moisture barrier layer, attaching the sleeve sections of thermal protective material to the arm length sleeve parts of the moisture barrier layer, whereby the firefighter's arms have thermal protection provided by the short sleeves of the fire station shirt of thermal protective material and the sleeve sections of thermal protective material, whereby the firefighter's bunker coat is prepared for firefighting use when the firefighter wears a fire station shirt and whereby the firefighter is properly protected by thermal protective material when the firefighter who wears the fire station shirt is wearing the firefighter's bunker coat, and whereby the firefighter's bunker coat has minimum weight and creates minimum stress upon the firefighter during firefighting activity.

* * * * *